United States Patent [19]

Jordan et al.

[11] Patent Number: 4,678,061

[45] Date of Patent: Jul. 7, 1987

[54] LADDER ROOF BRACE

[76] Inventors: Mark T. Jordan, 368 Shaw St., Braintree, Mass. 02184; Mark Ferragamo, 18 Oakwood Dr., Randolph, Mass. 02368

[21] Appl. No.: 826,687

[22] Filed: Feb. 6, 1986

[51] Int. Cl.[4] ..... E06C 5/36; E06C 7/42; E06C 7/48

[52] U.S. Cl. ..... 182/206; 182/107

[58] Field of Search ..... 182/206, 107, 108, 214; 248/237

[56] References Cited

U.S. PATENT DOCUMENTS

| | | | |
|---|---|---|---|
| 31,963 | 4/1861 | Farrar | 182/206 |
| 341,950 | 5/1886 | Sharpe et al. | 248/237 |
| 556,464 | 3/1896 | Haffermehl | 182/206 |
| 754,776 | 3/1904 | Johnson | 182/206 |
| 1,018,877 | 2/1912 | Chickering | 182/206 |
| 1,252,224 | 1/1918 | Bittner | 182/206 |
| 1,431,068 | 10/1922 | Waney | 182/109 |
| 1,470,489 | 10/1923 | Schuh | 182/206 |
| 2,272,642 | 2/1942 | Owen | 182/206 |
| 2,316,723 | 4/1943 | Sorensen | 182/206 |
| 2,448,716 | 9/1948 | Hurd | 182/206 |
| 3,606,226 | 9/1971 | Bell | 182/206 |

*Primary Examiner*—Reinaldo P. Machado

[57] ABSTRACT

The invention disclosed herein comprises a ladder roof brace which includes adjustable means of engaging the rungs of a ladder, means of bearing against both sides of a roof over a ridge and means of engaging a gutter.

1 Claim, 8 Drawing Figures

LADDER ROOF BRACE

BACKGROUND OF THE INVENTION

This invention relates generally to a ladder hook comprising a base portion, a roof bearing portion, an adjustable, hook element and a gutter hook. Hook of the general type are disclosed in the U.S. Pat. Nos.: to Sharpe et al 341,950; Chickering 1,018,877 and Bittner 1,252,224.

SUMMARY OF THE INVENTION

The invention disclosed herein comprises a ladder hook comprising a base portion, a roof bearing portion and an adjustable, hook element. The roof bearing portion is attached to the second terminal end, extends in a direction opposite to that of the first hook portion and has its free terminal end arced. The base portion having a first terminal end, a second terminal end and a longitudinal slot, the first terminal end being formed into a first hook portion and the second terminal end being formed into a support portion, the hook element formed into a second hook portion and having means of movably engaging the longitudinal slot, the roof bearing portion and the second terminal end providing a V shaped configuration adapted to engage the roof ridge of a building or the like.

The ladder hook further includes a gutter hook which extends from the base portion in angular relation thereto toward the same plane as that toward which the first hook portion extends.

BRIEF DESCRIPTION OF THE DRAWINGS

Further details are explained below with the help of the examples illustrated in the attached drawings in which.

DESCRIPTION OF THE PREFERRED EMBODIMENT(S)

Figure 1:
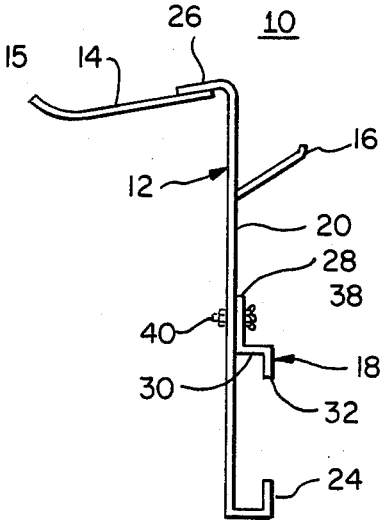
FIG. 1 is an side elevational view of the ladder hook according to the present invention with the handle broken off.
Figure 2:
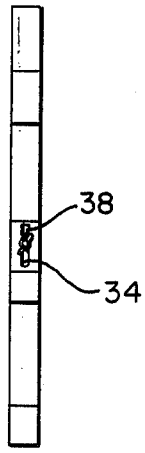
FIG. 2 is a top plan view of the ladder hook according to the present invention.
Figure 3:
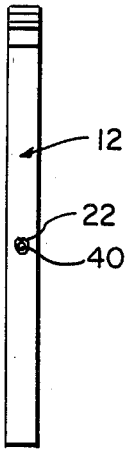
FIG. 3 is a bottom plan view of the ladder hook according to the present invention.

There is shown in the drawings at FIG. 1 a ladder hook 10 including a base portion 12, a roof bearing portion 14, a gutter engaging portion 16 and an adjustable hook element 18.

The base portion 12 comprises a center portion 20 having a first terminal end, a second terminal end and a hole 22 The first terminal end of the base portion 12 is formed into a first hook portion 24 and the second terminal end being formed into a support portion 26. The hole 22 of the base portion 12 is positioned between the first and second terminal end. The ladder hook 10 is formed of rectangular strips of steel or iron.

The hook element 18 is formed generally into a second hook portion and has means of movably engaging the hole 22 in the base portion 12. More specifically the hook element 18 comprises a support engaging portion 28, an intermediate portion 30 and an end portion 32. The intermediate portion has a first end and a second end. The first end is in integral angular relationship with the support engaging portion 28 and the second end in integral angular relationship with the end portion 32. The end portion 32 and the support portion 26 extend away from each other and lie on planes that are in parallel relation to each other. The support portion 26 of the hook element 18 has a through longitudinal slot 34 formed therein.

The roof bearing portion 14 is welded or otherwised attached to the second terminal end of the base portion 12 extending in a direction opposite to that of the first hook portion 24. The roof bearing portion 14 includes a free terminal end 15 which is arced slightly as shown in FIG. 1. The roof bearing portion 14 and the second terminal end of the base portion 12 provides a V shaped configuration adapted to engage the roof ridge of a building 36 or the like.

A nut 38 and a threaded headed bolt 40 may be the means of engaging the longitudinal slot 34 of the hook element 18 and the hole 22 of the base portion 12. To assemble the elements of the ladder hook 10, the support engaging portion 28 of the hook element 18 is placed into abutting relationship with the center portion of the base portion 12 and the hole 22 of the base portion 12 is positioned in register with the longitudinal slot 34 of the hook element 18. The headed bolt 40 has a shank which is passed through hole 22 and the longitudinal slot 34 positioning the head of the bolt 40 to bear against the bottom surface of the support engaging portion 28 and the nut 38 threadingly engages the shank of the bolt 40 on the opposite side of the center portion from that abutted by the hook element 18.

Figure 4:
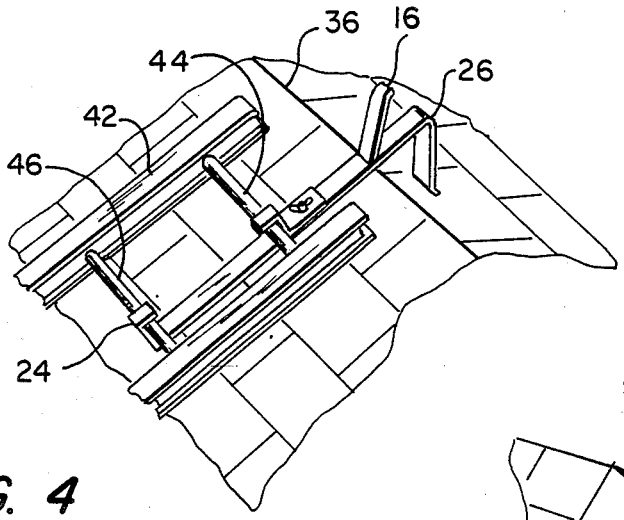
FIG. 4 is a perspective view of the ladder hook showing it engaged to a ladder, broken off, and to a roof ridge, broken off, according to the present invention.

As stated hereinbefore, the ladder hook 10 is used to engage the ridge of the roof of a building 36 to permit a ladder 42 to be secured to same. The ladder 42 includes a top rung 44 and a second rung 46 which is spaced from and in parallel relation with the top rung 44 in the usual manner. The ladder hook 10 is attached to the ladder 42 by hooking the first hook portion 24 of the base portion 12 around the second rung 46 in the manner shown in FIG. 4. This positions the base portion 12 so that, when engaged to the roof of a building 36, the central portion of the base portion 12 is in spaced parallel relation to the roof. In this position the sides of the ladder 42 bear against the roof. The hook element 18 is rotated and moved, through the longitudinal slot 34, in relation to the bolt 40 placing the intermediate portion 30 of the hook element 18 into abutting relation with the top rung 44. The nut 38 is then tightened securily attaching the ladder hook 10 to the ladder 42. If work is being done on a side of a roof having a ridge 48, the assembly of the ladder 42 and the ladder hook 10 is positioned on the roof as shown in FIG. 4 with the free terminal end 15 of the roof bearing portion 14 bearing against the other side of the roof from that against which the sides of the ladder 42 abutts. The V formed by the support portion 26 of the base portion 12 is spaced from the ridge 48.

Figure 5:
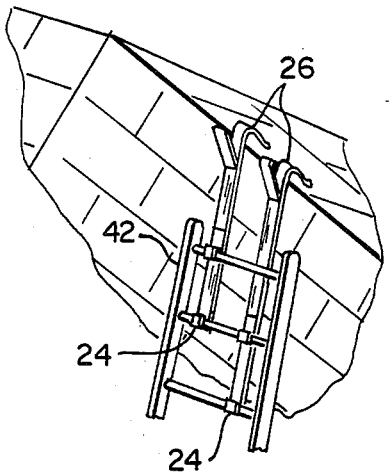
FIG. 5 is a perspective view of the ladder hook showing it engaged to a ladder, broken off, and to a roof ridge, broken off, according to the present invention.
Figure 6:
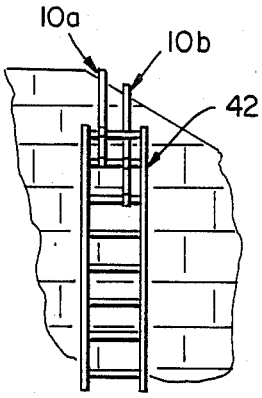
FIG. 6 is a front elevational view of a pair of ladder hooks showing them engaged to a ladder, the ladder broken off, and to a roof ridge, broken off, according to the present invention.
Figure 7:
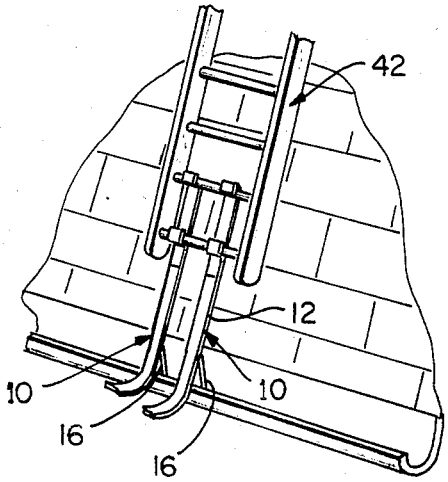
FIG. 7 is a perspective view of a pair of ladder hooks showing them engaged to a ladder, broken off, and to a roof gutter, broken off, according to the present invention.
Figure 8:
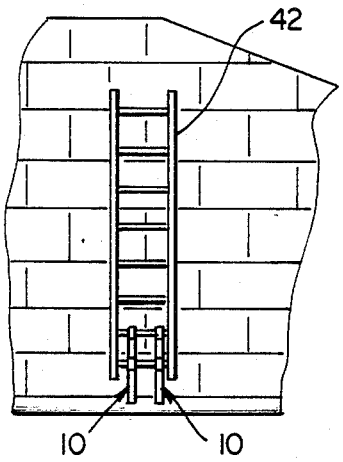
FIG. 8 is a front elevational view of a pair of ladder hooks showing them engaged to a ladder and to a roof gutter, broken off, according to the present invention.

If it is desired to work on the lower part of a slanted roof, which is well below a ridge 48, the free terminal ends of the gutter engaging portions 16, of two ladder hooks 10 which are positioned in spaced parallel relation to each other, are inserted into a gutter, wood for example, which should be carefully inspected to assure safety, positioning the assembly of the ladder 42 and the ladder hooks 10 so that the central portion of the base portions 12 bears against the roof, as shown in FIGS. 7 and 8.

Where a hipped roof is being worked on two ladder hooks 10*a*, 10*b* are utilized as shown in FIGS. 5 & 6. The ladder hooks 10*a*, 10*b* are identical in construction to the ladder hook 10 described hereinbefore. The first ladder hook 10*a* is attached to the ladder 42 by hooking the first hook portion 24*a* of the base portion 12*a* around the second rung 46 and the hook element 18*a* around the first rung 44 in the manner shown in FIGS. 5 and 6. The second ladder hook 10*b* is attached to the ladder 42 by hooking the first hook portion 24*b* of the base portion 12*b* around the third rung 50 and the hook element 18*b* around the second rung 46 in the manner shown in FIGS. 5 and 6.

What we claim is:

1. A ladder hook comprising a base portion, a roof bearing portion and an adjustable, hook element, the base portion comprising a center portion having a first terminal end, a second terminal end and a longitudinal slot, the first terminal end being formed into a first hook portion and the second terminal end being formed into a support portion, the longitudinal slot positioned between the first terminal end and the second terminal end, the hook element formed into a second hook portion and having means of movably engaging the longitudinal slot, the roof bearing portion attached to the second terminal end and extending in a direction opposite to that of the first hook portion, the roof bearing portion and the second terminal end providing a V shaped configuration adapted to engage the roof ridge of a building or the like, said ladder hook further comprising a gutter hook, the gutter hook extending from the center portion of the base portion in angular relation thereto toward the same plane as that toward which the first hook portion extends and positioned between the second terminal end and the longitudinal slot.

* * * * *